US006892400B1

(12) United States Patent
Choi et al.

(10) Patent No.: US 6,892,400 B1
(45) Date of Patent: May 17, 2005

(54) HELMET HAVING OPENING TYPE CHIN PROTECTION BAR

(75) Inventors: Kwang-Moon Choi, Suwon-si (KR); Kwang-Ho Pyo, Incheon-si (KR); Bom-Shik Cho, Yongin-si (KR)

(73) Assignee: HJC Co., Ltd., Kyunggi-do (KR)

( * ) Notice: Subject to any disclaimer, the term of this patent is extended or adjusted under 35 U.S.C. 154(b) by 0 days.

(21) Appl. No.: 10/757,020

(22) Filed: Jan. 14, 2004

(30) Foreign Application Priority Data

Dec. 24, 2003 (KR) ..... 10-2003-0096273

(51) Int. Cl.[7] ..... A42B 3/00
(52) U.S. Cl. ..... 2/424
(58) Field of Search ..... 2/424, 425, 410, 2/10

(56) References Cited

U.S. PATENT DOCUMENTS 4,397,047 A 8/1983 Nava
4,769,857 A * 9/1988 Cianfanelli et al. ..... 2/424
5,084,918 A 2/1992 Breining et al.
5,901,369 A 5/1999 Pilney
6,212,689 B1 4/2001 Lee
6,226,803 B1 5/2001 Tanaka
6,237,161 B1 * 5/2001 Lee ..... 2/414
6,249,918 B1 6/2001 Lacroix
6,598,238 B2 7/2003 Hong et al.
2003/0182716 A1 * 10/2003 Wu ..... 2/424

* cited by examiner

*Primary Examiner*—Rodney M. Lindsey
(74) *Attorney, Agent, or Firm*—R. Neil Sudol; Henry D. Coleman; William J. Sapone

(57) ABSTRACT

The present invention relates to a helmet having an opening type chin protection bar, which includes a helmet body having a face protection opening in a front side, a chin protection bar designed to protect a user's chin by blocking a part of the opening of the helmet body, a shield for shielding the remaining portions of the opening on an upper side of the chin protection bar, a hinge mechanism engaged to be rotatable in the upper and lower directions by engaging the chin protection bar to the left and right sides of the helmet body, and a locking mechanism designed to rotate the chin protection bar in the upper and lower directions with respect to the hinge bolt of the hinge mechanism as a shaft wherein the chin protection bar is locked in a lowered state, and is unlocked for its lifting operation.

6 Claims, 7 Drawing Sheets

HELMET HAVING OPENING TYPE CHIN PROTECTION BAR

BACKGROUND OF THE INVENTION

1. Field of the Invention

The present invention relates to a helmet having an opening type chin protection bar, and in particular to a helmet having and opening type chin protection bar that is capable of achieving the simpler appearance by improving a hinge mechanism of U.S. Pat. No. 6,598,238 (Jaw Protecting Apparatus of Helmet,) hereinafter reffered to as "the prior art") and is capable of achieving a more efficient opening and closing operation of a chin protection bar by improving an opening and closing locking unit of the chin protection bar.

2. Description of the Background Art

Generally, when riding a two-wheeled vehicle such as a motorcycle, etc., it is needed to wear a head protection helmet for protecting a rider's head. A shield is installed in a front side of the helmet for thereby preventing any interference of a visual field of a rider by a wind blowing from a forward side and any breathing problem.

In a conventional helmet, a chin protection bar is installed in a front lower side of the helmet for protecting a rider's chin. Both sides of the chin protection bar are fixed to both sides of a helmet body. The chin protection bar fixed to the helmet is stably fixed for preventing disengagement from the helmet.

In a state that the rider wears a helmet, the rider cannot talk with a certain person or cannot drink any beverage or cannot smoke. In addition, in a state that a buffering material is provided in the interior of an outer layer of a conventional chin protection bar of the helmet, since a fixture operating as a center of the weight is fixed at the center of the body of the helmet, the weight of the chin protection bar is applied to a front side of the user during the use of the helmet. Therefore, the feeling of use of the helmet is bad.

The prior art is provided to overcome the above-described problems. In the opening and closing structure of the chin protection member 4, there are two examples.

In the first example, as shown in FIG. 1, a shield 3 is installed in a front opening portion of a helmet body 1 rotatably in the upper and lower directions. A chin protection bar 4 having a buffering material is installed in a lower front side of the shield 3. As shown in FIG. 1, a fixture 5 having an engaging shoulder is installed at both sides of the helmet body 1. Opposite lockers 7 are installed at both sides of the chin protection bar 4 wherein the lockers 7 are supported by a guide 6, respectively, and rotate with respect to a shaft 8.

In addition, a support member 9 is installed in a front inner side of the chin protection bar 4. A movable member 10 having a handle 11 is installed. A center portion of a connector 12 connected with the lockers 7 is fixedly installed at the movable member 10. As the movable member 10 is rotated, the connector 12 is pulled, and then the lockers 7 are rotated. As the lockers 7 are rotated, the locking state is unlocked from the engaging shoulder of the fixture 5.

In the second example, as shown in FIG. 2, a guide 701 is installed at one side of a fixture 501 having an engaging shoulder. A locker 601 elastically supported by a spring 23 is slidable in an elongated hole 602 of the guide 701. Both ends of a wire 25 guided by a wire guide 24 at an inner side of the chin protection bar 4 are, respectively, fixed to a movable member 101 and a locker 601. As the movable member 101 is operated, the locker 601 slides and is escaped from the engaging shoulder of the fixture 501 for thereby unlocking the locked state.

But the above-described conventional examples have the following problems.

In the construction of the first example, the connector 12 capable of transferring the force of the movable member 10 for rotating the locker 7 has a stable structure, and the parts of the same are simple for thereby achieving an easier assembling operation. And the connector 12 has a good durability. However, the locker 7 and the guide 6 are needed, and a large number of other parts for the guide are needed. Therefore, the fabrication cost is high, and an assembling property and durability are decreased.

In the construction of the second example, the locker 701 has a relatively simple sliding structure, so that an assembling property and durability are good. However, the wire 25 for moving the locker 601 and the wire guide 24 are needed. In addition, a large number of parts for connecting the above elements are needed. Therefore, an assembling property and durability are bad, and the fabrication cost is high.

The hinge mechanism adapted to upwardly move the whole construction of the conventional chin protection bar 4 has the following problems: Since a hinge bolt for the fixing shaft 15 is engaged in a direction from the outer side of the chin protection bar 4 to the interior of the helmet body 1, the head of the hinge bolt is exposed to the outside.

In addition, the engaged hinge bolt may affect the movement of the chin protection bar based on an engaging degree. Therefore, since there is no member for limiting the engaging degree, it is impossible to achieve a desired hinge function.

SUMMARY OF THE INVENTION

It is the objects of the present invention to provide a helmet having an opening type chin protection bar that overcomes the problems encountered in the conventional art.

Accordingly, it is the object of the present invention to provide a helmet having an opening type chin protection bar that is capable of improving a hinge mechanism adapted to open a chin protection bar and having a good look and a stable engaging force and movement friction force in such a manner that a hinge bolt is engaged in a direction from an inner side of a helmet body to an outer chin protection bar.

It is another object of the present invention to provide a helmet having an opening type chin protection bar that is capable of achieving an easier screw assembling operation in such a manner that a guide rib is formed in a surrounding portion of a female screw in an engaging plate, and an end of a hinge bolt is well guided even though an inner side of a helmet is not well seen in assembling a hinge bolt.

It is further another object of the present invention to provide a helmet having an opening type chin protection bar that is capable of preventing a hinge bolt from loosening by forming a protrusion and a groove between a guide rib and a spacer.

It is still further another object of the present invention to provide a helmet having an opening type chin protection bar that is capable of simplifying the parts in such a manner that a force of an unlock lever exposed to a front lower side is directly transferred to a slider through an arc-shaped band type connector for thereby enhancing an assembling property and decreasing a fabrication cost.

It is still further another object of the present invention to provide a helmet having an opening type chin protection bar capable of decreasing a loss of force by making the pulling direction of an unlock lever same as the sliding direction of a slider and achieving a stable durability even though an opening type chin protection bar is repeatedly used, and the error is decreased, and the life span is increased for thereby enhancing a quality of the product.

To achieve the above objects, there is provided a helmet having an opening type chin protection bar, comprising a helmet body having a face protection opening in a front side; a chin protection bar designed to protect a user's chin by blocking a part of the opening of the helmet body; a shield for shielding the remaining portions of the opening on an upper side of the chin protection bar; a hinge mechanism engaged to be rotatable in the upper and lower directions by engaging the chin protection bar to the left and right sides of the helmet body and not exposed to the outside by inserting a hinge bolt in a direction from the inner side of the helmet body to the outer side; and a locking mechanism designed to rotate the chin protection bar in the upper and lower directions with respect to the hinge bolt of the hinge mechanism as a shaft wherein the chin protection bar is locked in a lowered state, and is unlocked for its lifting operation.

The hinge mechanism includes a female screw symmetrically attached to left and right inner sides of the chin protection bar wherein the female screw is engaged and embedded; an engaging plate having a guide rib provided in a surrounding portion of the female screw; and a hinge bolt engaged with the female screw and having a spacer.

The screw guide rib includes a plurality of protrusions and grooves, and the spacer includes protrusions corresponding to the protrusions and grooves of the screw guide rib for thereby preventing a screw from loosening when assembled with each other.

The locking mechanism includes a pair of fixtures symmetrically attached to both inner surfaces of the helmet body and each having a locking groove; left and right sliders formed in such a manner that the front ends of the same are inserted into the locking grooves of the fixtures and are escaped from the locking grooves of the same; a slider block attached to an inner side of the chin protection bar for guiding a sliding of the sliders and preventing an escape of the same; springs connected between the slider blocks for a return of the sliders; a connector connected along a center inner surface of the chin protection bar in an arc shape wherein the both ends of the connector are connected with the rear ends of the sliders for concurrently operating the left and right sliders; and a unlock lever crossed in a vertical direction for forwardly pulling an intermediate portion of the connector wherein the upper end of the unlock lever is connected with an inner side of the chin protection bar, and the lower end of the same is partially exposed to the lower side of the chin protection bar.

The front ends of the slider blocks are partially inserted into the locking grooves of the fixtures for preventing any movements in the locked state. The unlock lever is crossed with the connector and has a holding part for preventing the movement of the connector.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
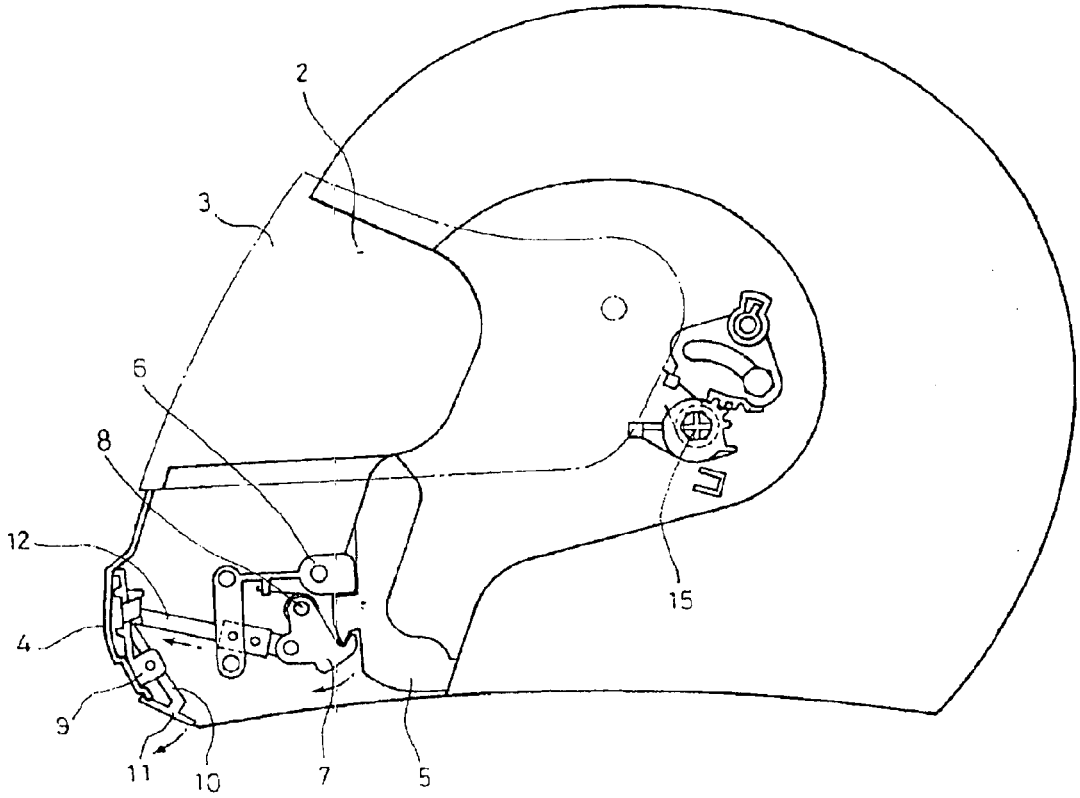
FIG. 1 Prior Art
FIG. 1 is a lateral view illustrating the construction of a conventional art.
Figure 2:
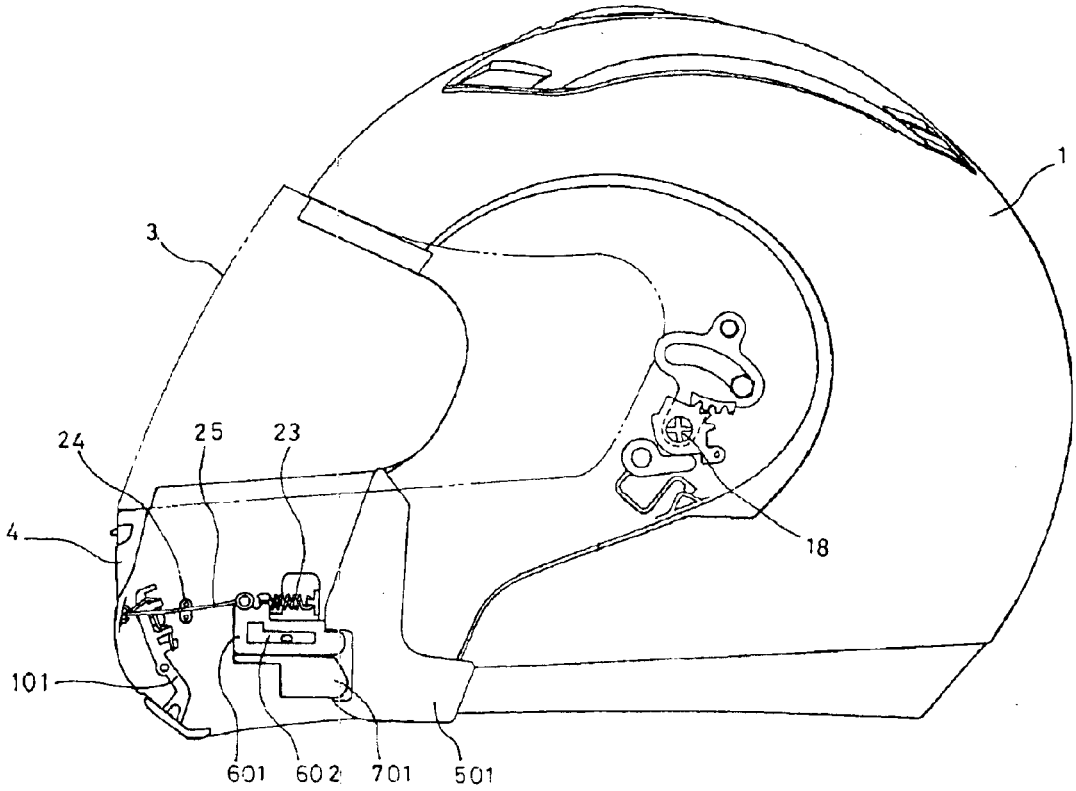
FIG. 2 Prior Art
FIG. 2 is a lateral view illustrating the construction of another conventional art.
Figure 3:
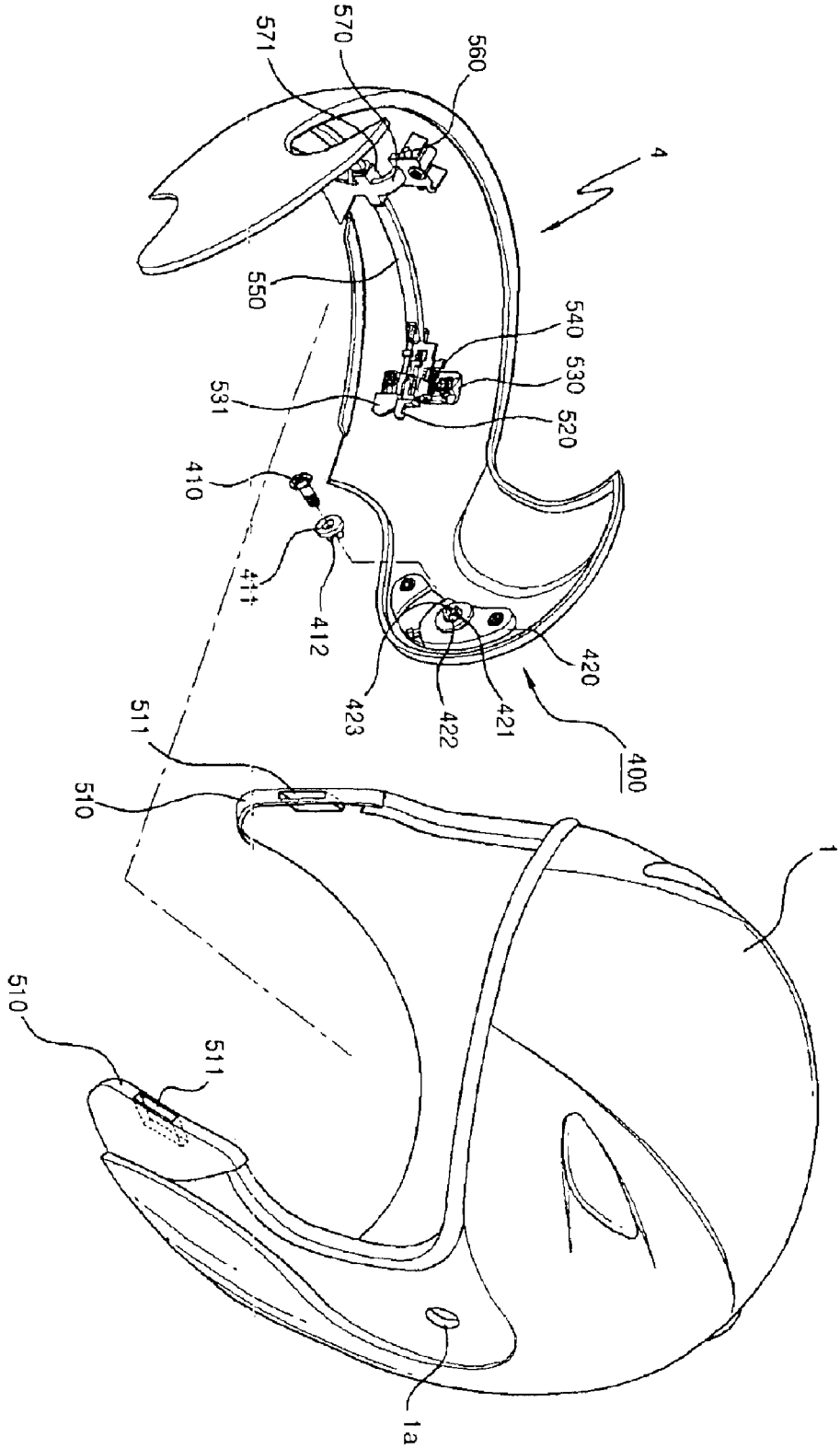
FIG. 3 is a lateral view illustrating the construction of a helmet having an opening type chin protection bar according to the present invention.
Figure 4:
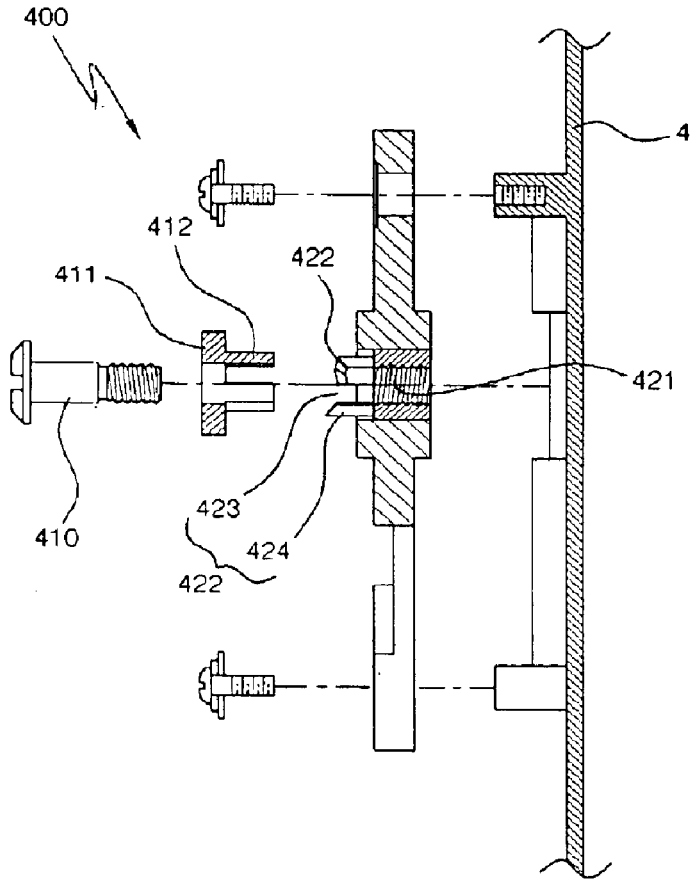
FIG. 4 is a disassembled cross sectional view illustrating a hinge mechanism according to the present invention.
Figure 6:
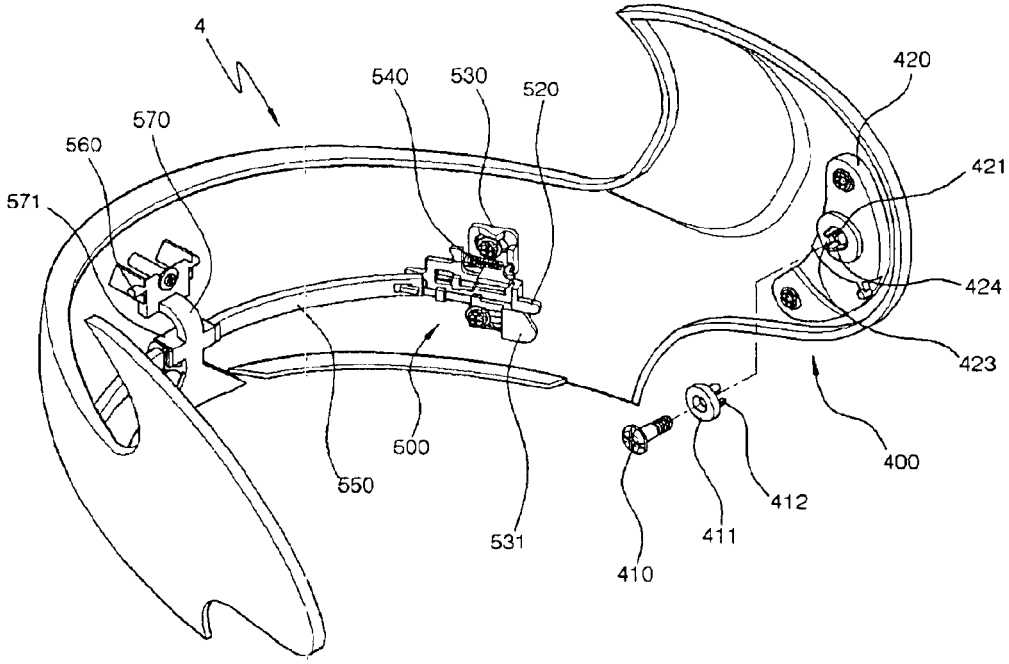
FIG. 6 is a partial perspective view illustrating a locking mechanism according to the present invention.

FIG. 3 is a lateral view illustrating the construction of a helmet having an opening type chin protection bar according to the present invention, FIG. 4 is a disassembled cross sectional view illustrating a hinge mechanism according to the present invention, and FIG. 6 is a partial perspective view illustrating a locking mechanism according to the present invention.

The helmet having a chin protection bar according to the present invention includes a helmet body 1 having an opening 2 for a front side of a user's face, a chin protection bar 4 capable of protecting a users chin by blocking a part of the opening of the helmet body, and a shield 3 adapted to shield the remaining portions of the opening 2 above the chin protection bar 4.

In the present invention, a hinge mechanism and a locking mechanism of the chin protection bar 4 are improved.

As shown in FIG. 4, in the hinge mechanism 400, the chin protection bar 4 is engaged to the left and right sides of the helmet body 1 rotatably in the upper and lower directions. An engaging hinge bolt 410 is inserted in a direction from the inner side of the helmet body 1 to an outer side, so that the engaging hinge bolt 410 is not exposed to the outside.

The hinge mechanism 400 is symmetrically attached to the left and right sides of the chin protection bar 4 and includes a female screw 421 that is engaged in an embedded state, an engaging plate 420 having a guide rib 422 provided in a surrounding portion of the female screw, and a hinge bolt 410 engaged to the female screw 421 and having a spacer 411.

Figure 5:
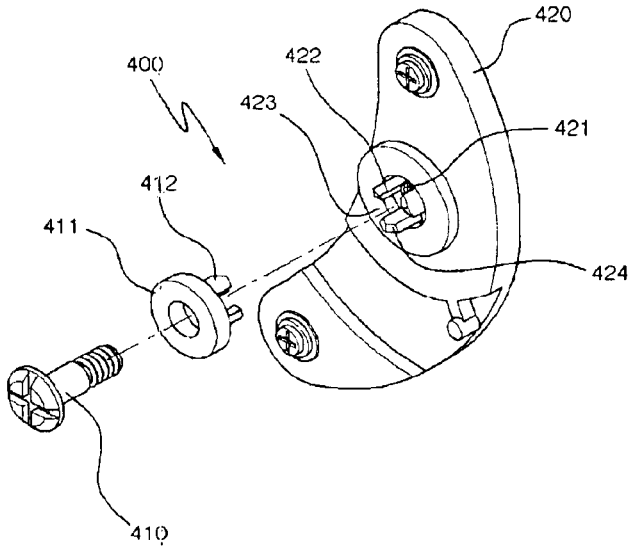
FIG. 5 is an enlarged perspective view illustrating a hinge mechanism according to the present invention.

At this time, as shown in FIG. 5, the screw guide rib 422 includes a plurality of protrusions 424 and grooves 423 formed in a radial shape. The spacer 411 includes protrusions 412 corresponding to the protrusions 424 and the grooves 423 grooves of the screw guide rib for thereby performing a function of the spacer. When assembled with each other, it is possible to prevent a loosening of the screw.

As shown in FIG. 3, in the locking mechanism 500, the chin protection bar 4 is movable in the upper and lower directions with respect to a hinge bolt 410 of the hinge mechanism 400. The chin protection bar 4 is locked in the lowered state and is unlocked for the movement in the upward direction.

As shown in FIG. 6, a pair of fixtures 510 each having a locking groove 511 are symmetrically attached to both inner sides of the helmet body 1. Left and right sliders 520 provided wherein the front ends of the same are inserted into the locking grooves 511 of the fixtures 510 and are escaped from the locking grooves 511. A slider block 530 is provided in the interior of the chin protection bar for guiding the sliding of the sliders 520 and preventing an escape of the same. A spring 540 is connected between the slider blocks for a return of the sliders 520.

A connector 550 is provided for concurrently operating the left and right sliders 520 wherein both ends of the connector 550 are connected with the rear ends of the sliders 520, and the connector 550 is connected along a center inner surface of the chin protection bar 4 in an arc shape. A unlock lever 570 is provided and crossed in a vertical direction for forwardly pulling an intermediate portion of the connector 550 wherein the upper end of the unlock lever 570 is connected with an inner side of the chin protection bar 4 using a lever hinge 560, and the lower end of the unlock lever 570 is partially exposed to the lower side of the chin protection bar 4.

Figure 7:
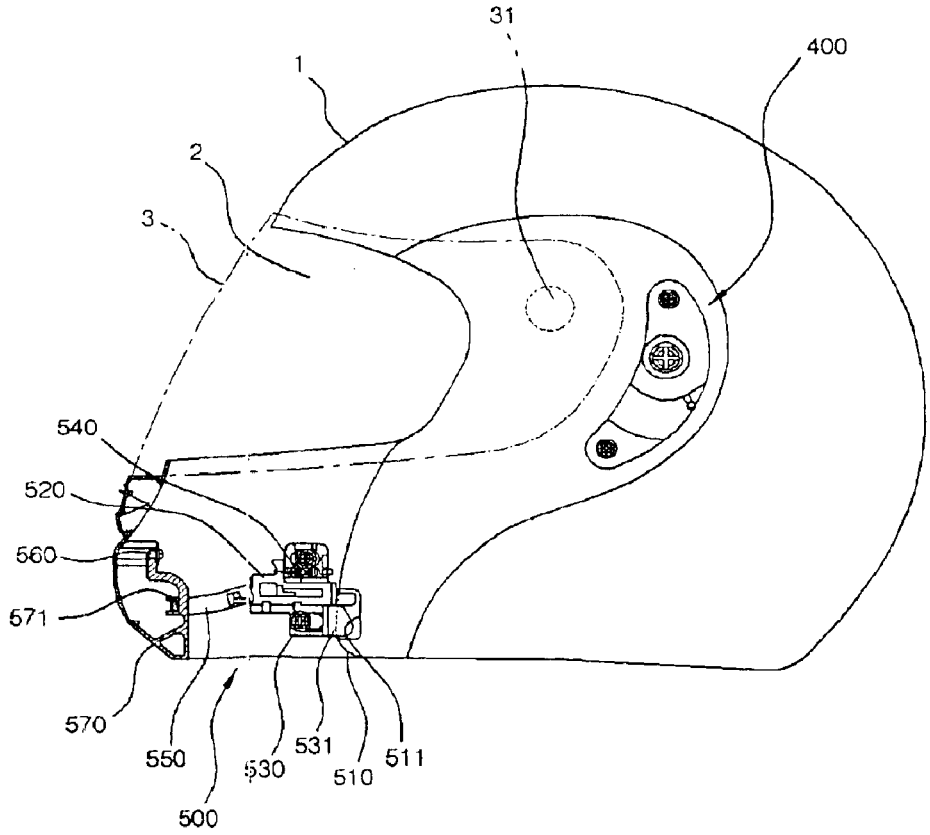
FIG. 7 is an inner lateral view illustrating a locking mechanism according to the present invention.

At this time, as shown in FIG. 7, the front ends of the slide blocks 530 are partially inserted into the locking grooves 511 of the fixtures 510 for preventing the movements of the locking states during the locking operation. The unlock lever 570 is crossed with the connector 550 and has a holding part 571 for preventing the movement of the connector 550.

In the drawings, reference numeral 31 represents a shaft part for opening and closing the shield.

The operation of the present invention will be described with reference to the accompanying drawings.

In order to assemble the chin protection bar 4 to the helmet body 1 using the hinge bolt 410 of the hinge mechanism 400, an engaging plate 420 is fixed to the left and right inner sides of the chin protection bar 4.

As shown in FIG. 4, the left and right side ends of the chin protection bar 4 to which the engaging plate 420 is fixed are abutted with both sides of the helmet body 1. And in a state that the hinge hole 1*a* of the helmet body 1 and the female screw 421 of the engaging plate 420 are arranged, the hinge bolt 410 is engaged.

At this time, the protrusions 412 of the spacer 411 are matched with the protrusions 424 and the grooves 423 of formed in the guide rib 422 of the engaging plate 420 for thereby obtaining a space for accommodating the thickness of the helmet body and preventing the screw from loosening.

The locking mechanism 500 is locked when the user lowers the chin protection bar 4 of the helmet and is unlocked when the user lifts the chin protection bar 4.

When the user lowers the chin protection bar 4 to the front side of the chin, the left and right sliders 520 forwardly moved by the spring 540 are inserted into the locking grooves 511 of the fixtures 510 fixed to the left and right sides of the chin protection bar 4, so that the chin protection bar 4 maintains a lowered state. In the case that the front end 531 that is a part of the slider block 530 is inserted together, it is possible to achieve a more stable locking state.

In the above state, when the chin protection bar 4 is supposed to be lifted, the unlock lever 570 exposed to the front lower side of the chin protection bar 4 is pulled.

Since the upper end of the pulled unlock lever 570 is connected with the lever hinge 560, a slight forward movement is performed, so that an intermediate portion of the connector 550 connected in the crossed state is pulled by the above movement operation.

Figure 8:
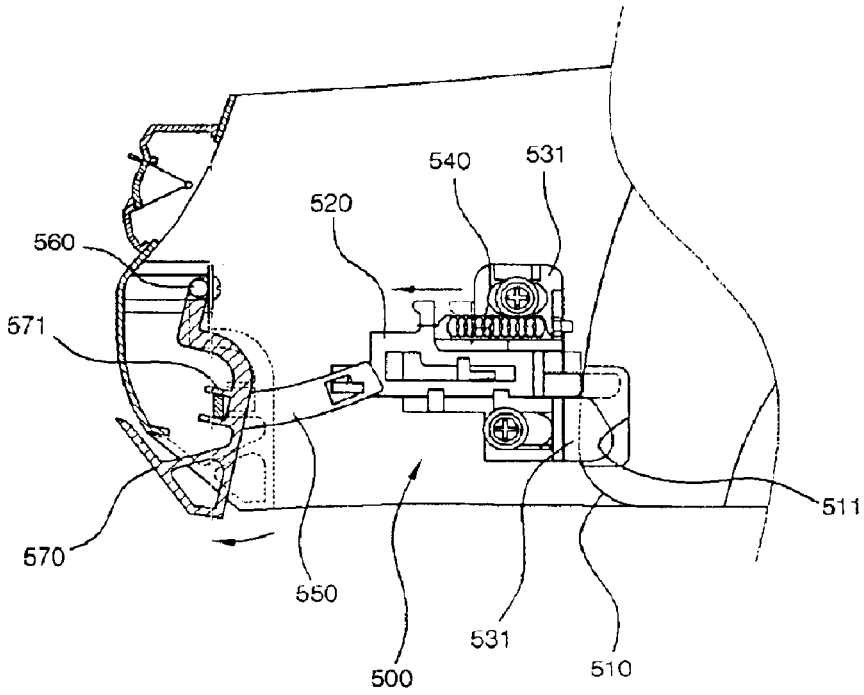
FIG. 8 is a partial lateral view illustrating an operation state of a locking mechanism according to the present invention.

When the connector 550 is forwardly pulled, since the both ends of the connector 550 are connected with the sliders 520 provided at the left and right sides of the chin protection bar 4, as shown in FIG. 8, the sliders 520 are backwardly moved.

When the sliders 520 are backwardly moved, since the sliders 520 are escaped from the locking grooves 511 of the fixtures 510, the chin protection bar 4 is changed from the locked state to the unlocked state. And the chin protection bar 4 is upwardly rotated with respect to the hinge bolt 410 of the hinge mechanism is 400.

The lifted chin protection bar 4 may be stopped in an opened state by a temporal open state maintaining member (not shown).

In addition, when the chin protection bar 4 is lowered, the left and right sliders 520 are returned to the original positions by the spring 540, and they are again inserted into the locking grooves 511 of the fixtures 5210 for thereby achieving a re-locking operation.

As described above, in the present invention, the hinge mechanism adapted to open the chin protection bar is improved, and the hinge bolt is engaged in a direction from the inner side of the helmet body to an outer chin protection bar. Therefore, the head of the hinge bolt is not exposed to the outside of the helmet, and the appearance of the helmet has a good look.

In addition, sine the guide rib is formed in a surrounding portion of the female screw in the engaging plate, the end of the hinge bolt is well guided even though the inner side of the helmet is not well seen during the assembling of the hinge bolt, so that a screw assembling operation is well performed. In addition, the loosening operation is prevented by the protrusions and grooves formed between the guide rib and the spacer. Since the hinge bolt is engaged in the inner side of the helmet, the user can easily fasten or loosen the hinge bolt.

In the locking mechanism of the chin protection bar according to the present invention, since a force of the unlock lever exposed to the front lower side is directly transferred to the slider through the arc-shaped band type connector, the construction of the parts is simple, and the fabrication cost is decreased, and the assembling property is largely enhanced.

In the present invention, since the pulling direction of the unlock lever is the same as the sliding direction of the slider, there is no loss of the force. Even when the chin protection bar of the helmet is repeatedly used for a long time, there is no over-load, so that the durability of the parts is enhanced, and there is not error, and the lifespan of the product is extended.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A helmet having an opening type chin protection bar, comprising:

a helmet body having a face protection opening in a front side;

a chin protection bar designed to protect a user's chin by blocking a part of the opening of the helmet body;

a shield for shielding the remaining portions of the opening on an upper side of the chin protection bar;

a hinge mechanism engaged to be rotatable in the upper and lower directions by engaging the chin protection bar to the left and right sides of the helmet body and not exposed to the outside by inserting a hinge bolt in a direction from the inner side of the helmet body to the outer side; and a locking mechanism designed to rotate the chin protection bar in the upper and lower directions with respect to the hinge bolt of the hinge mechanism as a shaft wherein the chin protection bar is locked in a lowered state, and is unlocked for its lifting operation, said hinge mechanism including:

a female screw symmetrically attached to left and right inner sides of the chin protection bar wherein the female screw is engaged and embedded;

an engaging plate having a guide rib provided in a surrounding portion of the female screw; and a hinge bolt engaged with the female screw and having a spacer.

2. The helmet of claim 1, wherein said screw guide rib includes a plurality of protrusions and grooves, and said spacer includes protrusions corresponding to the protrusions and grooves for thereby preventing a screw from loosening when assembled with each other.

3. The helmet of claim 1, wherein said screw guide rib includes a plurality of protrusions and grooves formed in a radial shape, and one protrusion among the protrusions is formed higher than others, so that the protrusions of the spacer are easily inserted into the grooves of the screw guide rib.

4. The helmet of claim 1, wherein said locking mechanism includes:

a pair of fixtures symmetrically attached to both inner surfaces of the helmet body and each having a locking groove;

left and right sliders formed in such a manner that the front ends of the same are inserted into the locking grooves of the fixtures and are escaped from the locking grooves of the same;

a slider block attached to an inner side of the chin protection bar for guiding a sliding of the sliders and preventing an escape of the same;

springs connected between the slider blocks for a return of the sliders;

a connector connected along a center inner surface of the chin protection bar in an arc; shape wherein the both ends of the connector are connected with the rear ends of the sliders for concurrently operating the left and right sliders; and a unlock lever crossed in a vertical direction for forwardly pulling an intermediate portion of the connector wherein the upper end of the unlock lever is connected with an inner side of the chin protection bar, and the lower end of the same is partially exposed to the lower side of the chin protection bar.

5. The helmet of claim 4, wherein the front ends of the slider blocks are partially inserted into the locking grooves of the fixtures for preventing any movements in the locked state.

6. The helmet of claim 4, wherein said unlock lever is crossed with the connector and has a holding part for preventing any movement of the connector.

* * * * *